US006158478A

United States Patent [19]

Lee et al.

[11] Patent Number: 6,158,478

[45] **Date of Patent: *Dec. 12, 2000**

[54] WEAR RESISTANT DESIGN FOR HIGH TEMPERATURE PAPERMACHINE APPLICATIONS

[75] Inventors: Henry J. Lee, Summerville; T. Payton Crosby, Walterboro, both of S.C.; Jeff Clegg, Mobile, Ala.; Rachel Kramer, Charleston, S.C.

[73] Assignee: AstenJohnson, Inc., Charleston, S.C.

[ * ] Notice: This patent is subject to a terminal disclaimer.

[21] Appl. No.: 09/191,900

[22] Filed: Nov. 13, 1998

Related U.S. Application Data

[60] Provisional application No. 60/081,661, Apr. 14, 1998.

[51] Int. Cl.[7] ..... D03D 13/00; D03D 11/00

[52] U.S. Cl. ..... 139/383 A; 139/425 A; 139/338 A; 139/383 R; 139/420 R; 139/420 B; 139/413; 442/181; 442/203; 442/207; 442/208

[58] Field of Search ..... 139/383 R, 420 R, 139/420 B, 408, 413, 383 A, 425; 442/181, 203, 207, 208

[56] References Cited

U.S. PATENT DOCUMENTS

| | | | |
|---|---|---|---|
| 5,358,014 | 10/1994 | Kovar | 139/383 A |
| 5,555,917 | 9/1996 | Quigley | 139/383 A |
| 5,975,149 | 11/1999 | Lee et al. | 139/383 |

FOREIGN PATENT DOCUMENTS

| | | |
|---|---|---|
| WO8704198 | 7/1987 | WIPO . |
| WO9117292 | 11/1991 | WIPO . |

*Primary Examiner*—Terrel Morris
*Assistant Examiner*—Christopher C. Pratt
*Attorney, Agent, or Firm*—Volpe and Koenig, P.C.

[57] ABSTRACT

A multilayer papermaking fabric having interwoven machine direction (MD) and cross-machine direction (CMD) yarns, the CMD yarns defining at least upper and lower CMD yarn subsets which are interwoven with the MD yarns in a repeat pattern such that the MD yarns have substantially more interweavings with the upper CMD yarn subset than with the lower CMD yarn subset. The lower subset CMD yarns define machine side floats under at least seven MD yarns and each MD yarn interweaves with only two lower subset CMD yarns in a given repeat.

13 Claims, 4 Drawing Sheets

100
120
122
124
110a
110b
110c
110d
110e
110f
110g
110h
110i
110j
110k
110l
110m
110n
110o
110p

WEAR RESISTANT DESIGN FOR HIGH TEMPERATURE PAPERMACHINE APPLICATIONS

This application claims the benefit of U.S. Provisional Application Ser. No. 60/081,661 filed Apr. 14, 1998.

BACKGROUND OF INVENTION

1. Field of the Invention

The present invention generally relates to a woven fabric designed for use in a papermaking machine. More particularly, the present invention relates to a woven fabric for use in a high temperature section of a papermaking machine.

2. Description of the Prior Art

A conventional papermaking machine forms a web by depositing a slurry of pulp fibers to be formed into a paper sheet on a traveling forming wire. After initial dewatering on the forming wire, the paper sheet or web is transferred to a press section where the web passes through a number of press nips formed between roll couples. The press nips serve to consolidate the solid ingredients of the paper and at the same time to increase the dewatering of the slurry. Thereafter, the web is transferred to a dryer fabric which passes it over a series of heated dryer drums and possibly through a calendar.

Dryer fabrics are generally formed from materials resilient to high temperatures and hydrolytic degradation. However, these materials are often prone to abrasion. Additionally, the stresses on the machine direction yarns cause fairly rapid wearing of the MD yarns, which shortens the life of the fabric.

Accordingly, there is a need for a fabric which can be formed from temperature and degradation resistant materials with less susceptibility to fabric wear.

SUMMARY OF THE INVENTION

The present invention relates to a multilayer papermaking fabric having interwoven machine direction (MD) and cross-machine direction (CMD) yarns. The CMD yarns define at least upper and lower CMD yarn subsets. The subsets are interwoven with the MD yarns in a repeat pattern such that the MD yarns have substantially more interweavings with the upper CMD yarn subset than with the lower CMD yarn subset. The lower subset CMD yarns define machine side floats under at least seven MD yarns and each MD yarn interweaves with only two lower subset CMD yarns in each repeat.

DESCRIPTION OF THE PREFERRED EMBODIMENTS

Figures 1, 2, 3, 4:
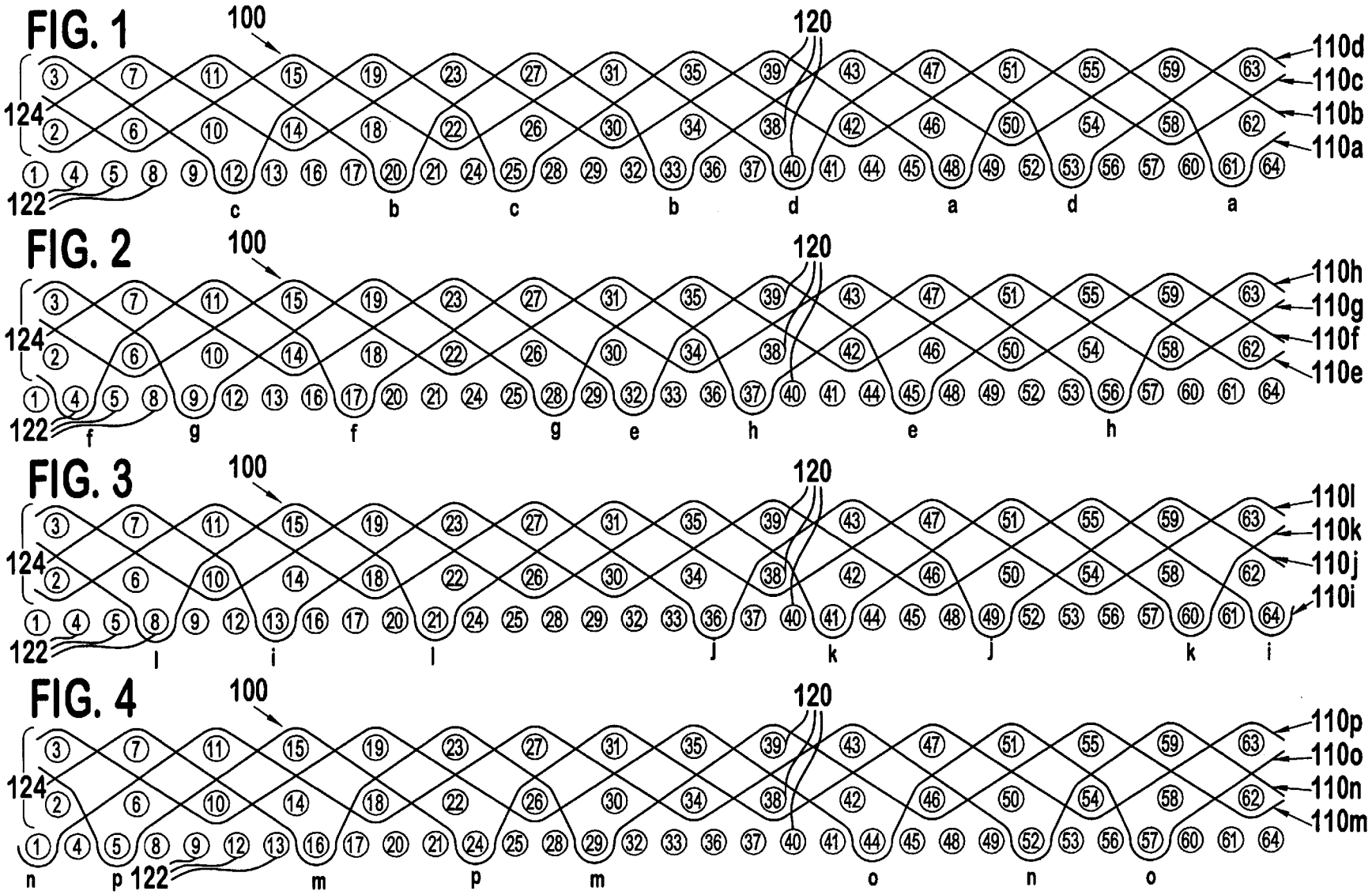
FIGS. 1–4 are weave structure diagrams of the preferred fabric of the present invention.
Figure 5:
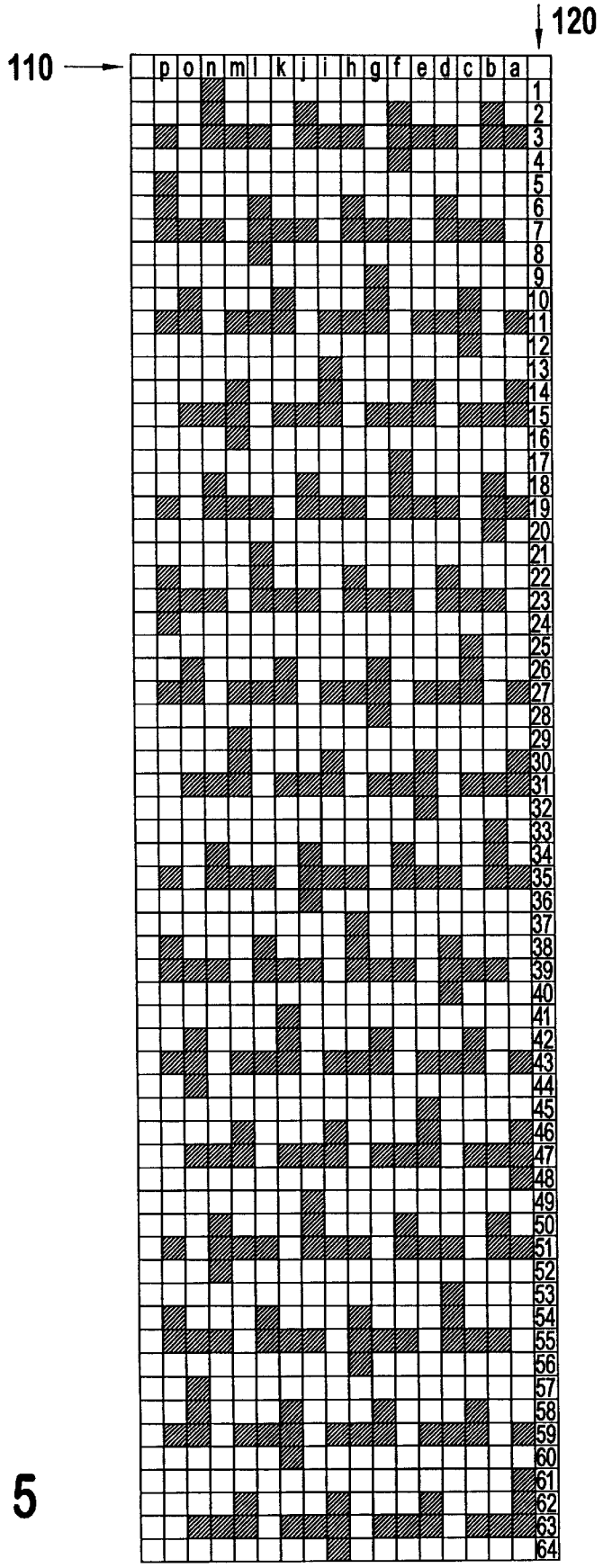
FIG. 5 is a weave pattern diagram of the preferred fabric wherein the darkened boxes represent where the MD yarns weave under a respective CMD yarn.

The preferred embodiment will be described with reference to the drawing figures where like numerals represent like elements throughout.

Referring to FIGS. 1–4, the preferred fabric 100 is shown. It generally comprises a system of MD yarns 110 interwoven with a system of CMD yarns 120. The CMD yarn system includes a lower machine contacting layer 122 and an upper layer 124. The upper layer 124 includes pairs of stacked CMD yarns 120. The lower layer 122 includes two adjacent CMD yarns 120 for every stacked pair of yarns in the upper layer 124.

The MD yarns 110 preferably weave in a pattern that repeats on sixty-four CMD yarns 120, but each MD yarn 110 weaves with only two CMD yarns of lower layer 122 in a given repeat. For example, MD yarn 110*a* weaves in a standard "N" weave pattern with the upper layer 124 until it weaves under lower layer 122 CMD yarns 48 and 61. These "stitching points" at 48 and 61 join the CMD yarns of upper and lower layers 122 and 124 together. As shown in FIGS. 1–5, yarn 110*b* stitches under yarns 20 and 33; yarn 110*c* stitches under yarns 12 and 25; yarn 110*d* stitches under yarns 40 and 53; yarn 110*e* stitches under yarns 32 and 45; yarn 110*f* stitches under yarns 4 and 17; yarn 110*g* stitches under yarns 9 and 28; yarn 110*h* stitches under yarns 37 and 56; yarn 110*i* stitches under yarns 13 and 64; yarn 110*j* stitches under yarns 36 and 49; yarn 110*k* stitches under yarns 41 and 60; yarn 110*l* stitches under yarns 8 and 21; yarn 110*m* stitches under yarns 16 and 29; yarn 110*n* stitches under yarns 1 and 52; yarn 110*o* stitches under yarns 44 and 57; and yarn 110*p* stitches under yarns 5 and 24.

Figure 6:
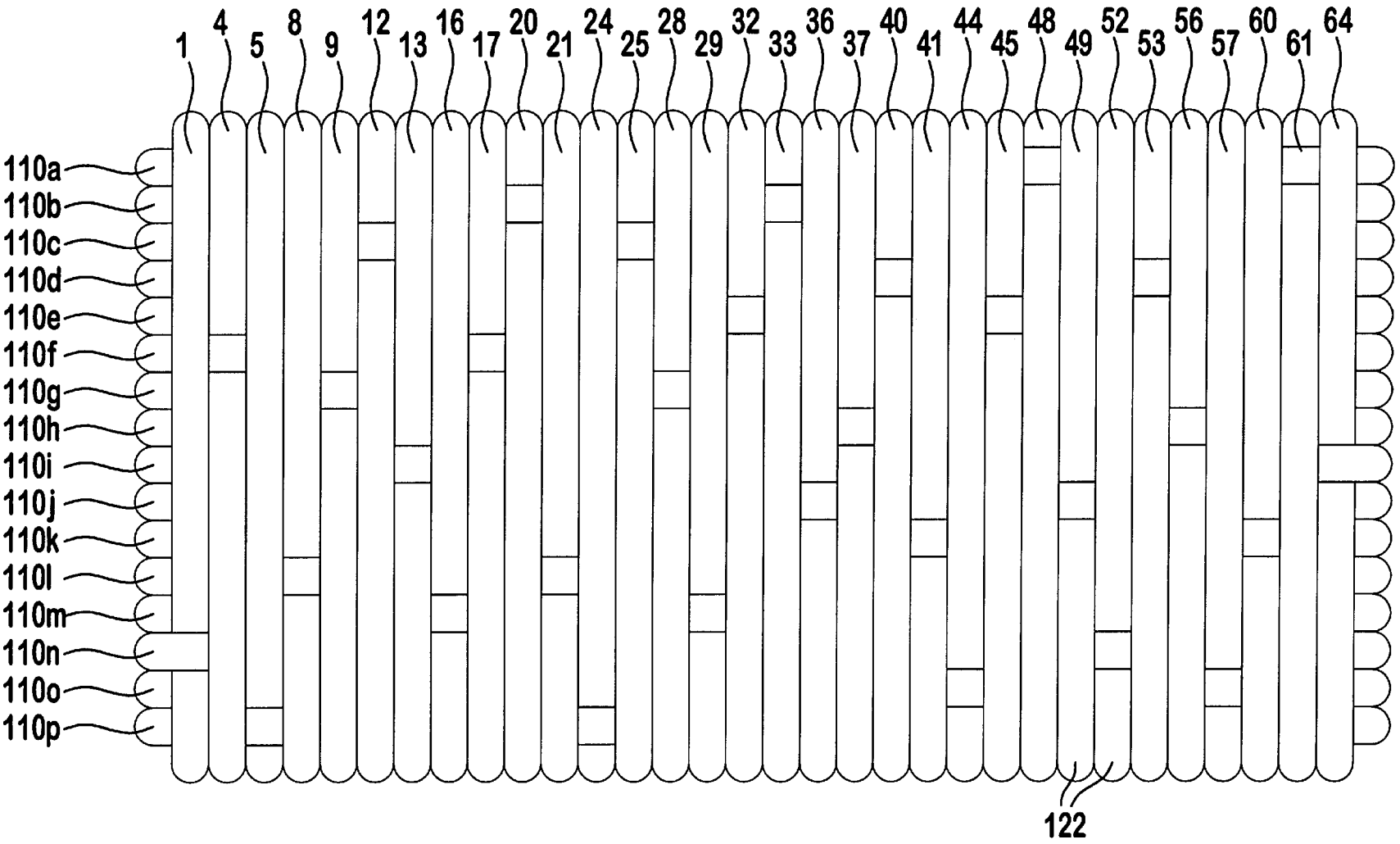
FIG. 6 is a bottom plan view of the preferred fabric.

As shown in FIG. 6, the reduced number of stitching points in the CMD yarns lower layer 122 produces floats that pass under fifteen of the MD yarns 110 in a given repeat. Each MD yarn 110 weaves with two lower layer 122 CMD yarns in a given repeat. These widely spaced interlacings allow the CMD yarns of lower layer 122 to be woven with minimum crimping. As such, the lower layer 122 CMD yarns extend below the plane of the MD yarns 110 machine side knuckles. This produces a machine contacting surface which is dominated by the CMD yarns in lower layer 122 and this protects the MD yarns 110. Preferably the yarns in lower layer 122 are monofilament yarns made from PCTA, Amodel or PET.

The CMD yarns of upper layer 124 and the MD yarns 110 can be of various materials. The MD yarns 110 are preferably made from a material having good tensile strength. Materials which also provide some temperature resistance, such as polyester or ryton, may be used. The fabric 100 can be endless woven or flat woven.

Figure 7:
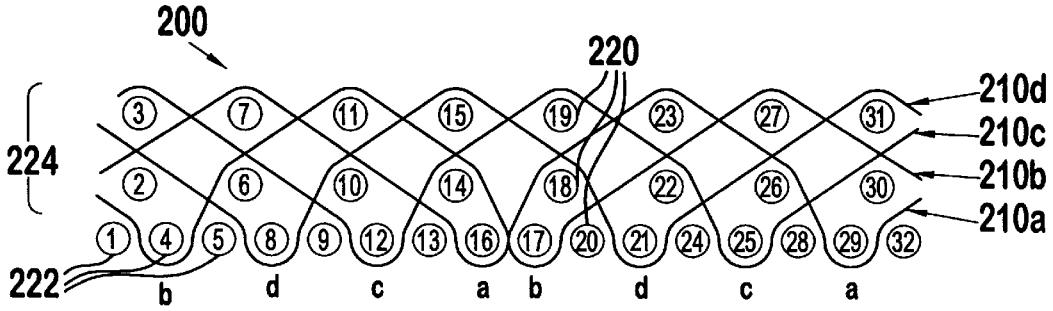
FIGS. 7–8 are weave structure diagrams of an alternate embodiment of the present invention.
Figure 8:
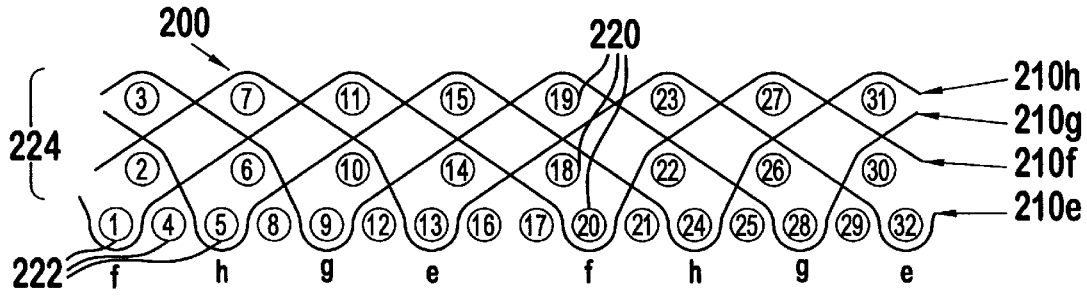

Referring to FIGS. 7–8, an alternate embodiment of the fabric 200 is shown. Similar to the preferred embodiment, fabric 200 also comprises a system of MD yarns 210 interwoven with a system of CMD yarns 220. The CMD yarn system 220 includes a lower machine contacting layer 222 and an upper layer 224. The upper layer 224 includes pairs of stacked CMD yarns 220 and the lower layer 222 includes two adjacent CMD yarns 220 for every stacked pair of yarns in the upper layer 224.

The MD yarns 210 of fabric 200 weave in a pattern that repeats on thirty-two CMD yarns 220 and weave with two lower layer CMD yarns 222 in a given repeat. For example, MD yarn 210*a* weaves between CMD yarns 2 and 3, over CMD yarn 7, between CMD yarns 10 and 11, under lower layer CMD yarn 16, between CMD yarns 18 and 19, over CMD yarn 23, between CMD yarns 26 and 27, and under lower layer CMD yarn 29 in a given repeat. Again, the lower layer CMD floats are in a plane lower than the MD yarn 210 machine side knuckles.

We claim:

1. A multilayer papermaking fabric comprising interwoven machine direction (MD) and cross-machine direction (CMD) yarns, the CMD yarns defining at least upper and lower CMD yarn layers that are interwoven with the MD yarns in a repeat pattern such that the MD yarns have substantially more interweavings with the upper CMD yarn layer than with the lower CMD yarn layer and the lower layer CMD yarns define machine side floats under at least seven MD yarns and each MD yarn interweaves with only two lower layer CMD yarns in each repeat.

2. The fabric of claim 1 wherein the lower layer CMD yarns weave in a pattern which includes a machine side float of at least fifteen MD yarns.

3. The fabric of claim 2 wherein the MD yarns repeat on sixty four CMD yarns.

4. The fabric of claim 2 wherein the upper CMD yarn layer includes pairs of stacked CMD yarns.

5. The fabric of claim 4 wherein the lower CMD yarn layer includes two adjacent CMD yarns for each stacked pair of upper layer CMD yarns.

6. The fabric of claim 5 wherein each MD yarn weaves over an upper CMD yarn stacked pair, between an upper CMD yarn stacked pair, under a lower CMD yarn, between an upper CMD yarn stacked pair, over an upper CMD yarn stacked pair, between an upper CMD yarn stacked pair, under a lower CMD yarn, between an upper CMD yarn stacked pair, over an upper CMD yarn stacked pair, between an upper CMD yarn stacked pair, under an upper CMD yarn stacked pair, between an upper CMD yarn stacked pair, over an upper CMD yarn stacked pair, between an upper CMD yarn stacked pair, under an upper CMD yarn stacked pair, and between an upper CMD yarn stacked pair in a given repeat.

7. The fabric of claim 1 wherein the lower layer CMD yarns are monofilament yarns made from a material selected from the group consisting of PCTA, Amodel, and PET.

8. The fabric of claim 1 wherein the MD yarns are warp yarns and the CMD yarns are weft yarns.

9. The fabric of claim 1 wherein the MD yarns are weft yarns and the CMD yarns are warp yarns.

10. The fabric of claim 1 wherein the MD yarns repeat on thirty two CMD yarns.

11. The fabric of claim 1 wherein the upper CMD yarn layer includes pairs of stacked CMD yarns.

12. The fabric of claim 11 wherein the lower CMD yarn layer includes two adjacent CMD yarns for each stacked pair of upper layer CMD yarns.

13. The fabric of claim 12 wherein each MD yarn weaves over an upper CMD yarn stacked pair, between an upper CMD yarn stacked pair, under a lower CMD yarn, between an upper CMD yarn stacked pair, over an upper CMD yarn stacked pair, between an upper CMD yarn stacked pair, under a lower CMD yarn, and between an upper CMD yarn stacked pair in a given repeat.

* * * * *